US005984843A

United States Patent [19]

Morton

[11] Patent Number: 5,984,843

[45] Date of Patent: Nov. 16, 1999

[54] FREE STANDING SAFETY BARBELL

[76] Inventor: Lee Robert Morton, 12 Penberth Rd., London, United Kingdom, SE6 1ES

[21] Appl. No.: 08/915,254

[22] Filed: Aug. 20, 1997

[30] Foreign Application Priority Data

Jan. 10, 1997 [GB] United Kingdom ..... 9700384

[51] Int. Cl.[6] ..... A63B 21/072; A63B 21/078

[52] U.S. Cl. ..... 482/106; 482/104

[58] Field of Search ..... 482/104, 106, 482/108, 93, 94, 107, 908

[56] References Cited

U.S. PATENT DOCUMENTS

| | | | |
|---|---|---|---|
| 2,470,815 | 5/1949 | Harvey | 482/104 |
| 3,290,044 | 12/1966 | Krodsen | 482/93 X |
| 3,904,198 | 9/1975 | Jones | 482/106 |
| 4,288,073 | 9/1981 | Petrachonis et al. . | |
| 4,319,747 | 3/1982 | Rogers | 482/104 X |
| 4,360,198 | 11/1982 | Waulters . | |
| 4,513,963 | 4/1985 | Nelson | 482/93 X |
| 4,717,147 | 1/1988 | Rochelle | 482/93 |
| 4,858,917 | 8/1989 | Montgomery | 482/106 |
| 4,890,831 | 1/1990 | Craig | 482/104 |
| 5,029,849 | 7/1991 | Nurkowski | 482/106 |
| 5,257,964 | 11/1993 | Petters . | |
| 5,496,240 | 3/1996 | Damm | 482/93 |

FOREIGN PATENT DOCUMENTS

| | | |
|---|---|---|
| 2 297 291 | 8/1996 | United Kingdom . |
| 2 321 022 | 7/1998 | United Kingdom . |

*Primary Examiner*—Danton D. DeMille
*Assistant Examiner*—William LaMarca
*Attorney, Agent, or Firm*—Iandiorio & Teska

[57] ABSTRACT

Exercise apparatus (2) for use in performing a variety of different physical exercises with weights (30), which exercise apparatus (2) includes first weight-receiving means (4) having a base (6) and an upstanding member (8) for receiving weights (30), second weight-receiving means (10) including a base (6) and an upstanding member (8) for receiving weights (30), and a bar (16) which is releaseably connectable to the first and the second weight-receiving means (4, 10), whereby the first and the second weight-receiving means (4, 10) are positioned one at each end of the bar (16) so that a person (28) performing the different physical exercises is able to hold the bar (16) between the first and the second weight-receiving means (4, 10).

2 Claims, 5 Drawing Sheets

FREE STANDING SAFETY BARBELL

This invention relates to exercise apparatus and, more especially, this invention relates to exercise apparatus for use in performing a variety of different physical exercises with weights.

Persons performing physical exercises with weights often prefer to use what are known as free weights. The free weights do not form an integral part of a physical exercise machine. The free weights are simply added to or taken off a bar until the person has a desired amount of weight on the bar. The free weights are normally in the form of discs with a central aperture for receiving the bar.

For some physical exercises with a bar and free weights, for example a bench press or a squat, it is not possible for a person to train to their maximum capability if the person is exercising on their own. The reason for this is that the bar is normally required to be replaced in a rack and the person must be sure to have enough strength left at the end of an exercise to replace the bar in the rack. If a person wishes to train to the limit of their strength and/or endurance, then it is usual to have one or two persons acting as assistants who will hand the bar to the person doing the physical exercise, and replace the bar after the physical exercise has been done. In this way, safety is ensured. However, it is not always convenient for a person to have one or more assistants standing by.

It is an aim of the present invention to obviate or reduce the above mentioned problem.

Accordingly, in one non-limiting embodiment of the present invention, there is provided exercise apparatus for use in performing a variety of different physical exercises with weights, which exercise apparatus comprises first weight-receiving means comprising a base and an upstanding member for receiving weights, second weight-receiving means comprising a base and an upstanding member for receiving weights, and a bar which is releaseably connectable to the first and the second weight-receiving means, whereby the first and the second weight-receiving means are positioned one at each end of the bar and a person performing the different physical exercises is able to hold the bar between the first and the second weight-receiving means.

The physical exercise apparatus is able to be used for perform the different physical exercises in safety because the physical exercise apparatus is basically freestanding and stable. Examples of the different physical exercises are bench press, shoulder press, upright rowing, bent over rowing, shrug and squats.

The exercise apparatus may be one in which the bar has a first right angled portion at a first end, and a second right angled portion at a second end, the first right angled portion being releaseably connectable to the first weight-receiving means, and the second right angled portion being releaseably connectable to the second weight-receiving means.

Preferably, the exercise apparatus is one in which the bar is releaseably connectable to the said weight-receiving means and the said extension members such that the weights on the weight-receiving means tend to hang vertically during exercising. It will be apparent that if the weight-receiving means tends to move backwards and forwards, this can adversely affect the balance of the physical exercise apparatus as it is being held during physical exercising. This in turn could adversely affect the ability of the person to perform the physical exercises. It is thus desirable that the weight-receiving means tends to hang vertically during exercising, especially with heavier weights.

Preferably, the exercise apparatus is one in which the first and the second right angled portions are tubes which in use fit over the first and the second weight-receiving means such that there is an annular gap between each said tube and its said first or second weight-receiving means, the annular gap enabling the weights on the first and the second weight-receiving means to hang vertically in use.

The exercise apparatus may be one in which the bar is releaseably connectable to the said weight-receiving means by pin and aperture arrangements. The exercise apparatus may thus be one in which the bar and the upstanding members all have apertures, and in which pins are employed to lock together two parts having registering apertures.

Preferably, the base of each of the first and the second weight-receiving means is a flat base which forms a stable platform for the first and the second weight-receiving means, whereby the first and the second weight-receiving means are stable and free standing when separated from the bar. The base will usually be a square base but other shaped bases such for example as circular bases may be employed if desired.

If desired, the base may be arranged to be smaller than weights on the first and the second weight-receiving means, whereby the base will then not be visible when the weights are present.

The upstanding member of each of the first and the second weight-receiving means will usually be of circular cross section. Other cross sectional shapes may however be employed.

The weights will usually be discs with a central aperture for receiving the bar. The weights may be made of metal, rubber or plastics materials as may be desired.

The exercise apparatus may be one in which the first and the second right angled portions are of such a length that when they are connected to the first and the second weight-receiving means, the exercise apparatus is ready for performing a squat exercise.

Alternatively, the exercise apparatus may include a first extension member which is releaseably connectable to the upstanding member of the first weight-receiving means at a position above the weights, and a second extension member which is releaseably connectable to the upstanding member of the second weight-receiving means at a position above the weights. The exercise apparatus may be such that the first and the second extension members are releaseably connectable to the upstanding members in the same manner that the upstanding members are connectable to the bar. Other ways of releaseably connecting the first and the second extension members to the upstanding members may be employed if desired.

Embodiments of the invention will now be described solely by way of example and with reference to the accompanying drawings in which.

Figure 1:
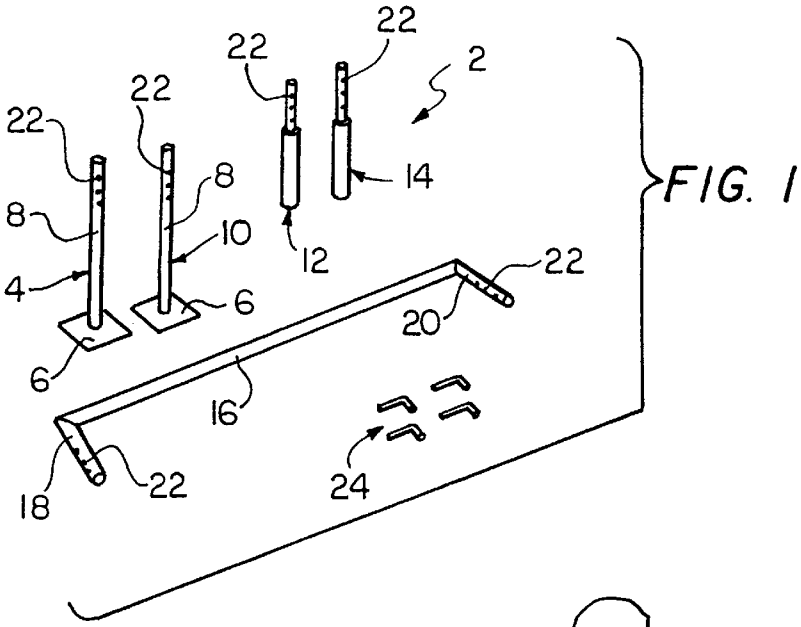
FIG. 1 shows the component parts of first physical exercise apparatus of the present invention.

Referring to FIG. 1, there is shown first exercise apparatus 2 for use in performing a variety of different physical exercises with weights. The exercise apparatus 2 comprises first weight-receiving means 4 comprising a base 6 and an upstanding member 8 for receiving weights. The exercise apparatus 2 also comprises second weight-receiving means 10. The second weight-receiving means 10 comprises a base 6 and an upstanding member 8 for receiving weights, the same as the first weight-receiving means 4.

The exercise apparatus 2 includes a first extension member 12 which is releaseably connectable to the upstanding member 8 of the first weight-receiving means 4 at a position above the weights. The exercise apparatus 2 also comprises a second extension member 14 which is releaseably connectable to the upstanding member 8 of the second weight-receiving means 10 at a position above the weights.

The exercise apparatus 2 further includes a bar 16 which is releaseably connectable to the first and the second weight-receiving means 4, 10, and also to the first and the second extension members 12, 14. The various connections are such that the first and the second weight-receiving means 4, 10 are positioned one at each end of the bar 16. A person performing the different physical exercises is able to hold the bar 16 between the first and the second weight receiving means 4, 10.

The bar 16 has a first right angled portion 18 at a first end, and a second right angled 20 at a second end. The first right angled portion 18 is a tube which is releaseably connectable to the first weight-receiving means 4 and the first extension member 12. The second right angled portion 20 is a tube which is releaseably connectable to the second weight-receiving means 10 and the second extension member 14. The portions 18, 20 have larger diameters than the parts over which they fit so as to leave an annular gap between the portions 18, 20 and the parts. This enables the parts to pivot with respect to the portions 18, 20. Thus, the various releaseable connections between the first and the second weight-receiving means 4, 10 and the first and the second extension members 12, 14 are such that the weights on the weight-receiving means 4, 10 tend to hang vertically during exercising. This helps to stop the weights swinging backwards and forwards or to and fro and thus helps to stop unbalancing a user of the exercise apparatus 2 during exercising.

The bar 16 is releaseably connectable to the weight-receiving means 4, 10 and to the first and the second extension members 12, 14 by pin and aperture arrangements. More specifically, the bar 16, the upstanding members 8 and the extension members 12, 14 all have sets of apertures 22 as shown. Pins 24 are employed to lock together any two parts of the exercise apparatus 2 having registering apertures 22. The base 6 of each of the first and the second weight-receiving means 4, 10 is a flat base which forms a stable platform for the first and the second weight-receiving means 4, 10. Thus the first and the second weight-receiving means 4, 10 are stable and free-standing when separated from the bar 16. The base 6 of each of the first and the second weight-receiving means 4, 10 is a square base as shown. Also as shown, the upstanding member 8 of each of the first and the second weight-receiving means 4, 10 is of circular cross section.

Figure 3:
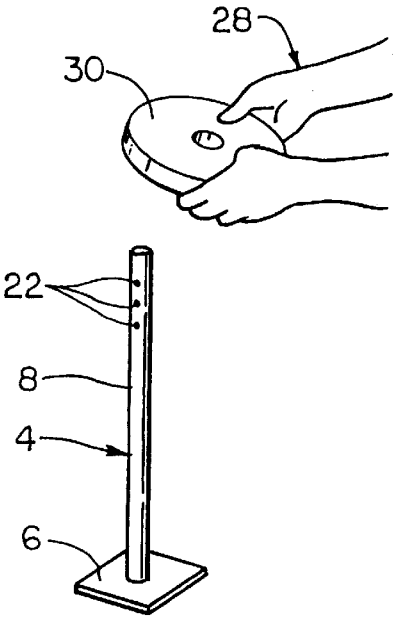
FIGS. 2–8 show how the physical exercise apparatus can be used without extension members for the purpose of performing a physical exercise known as a bench press.
Figure 2:
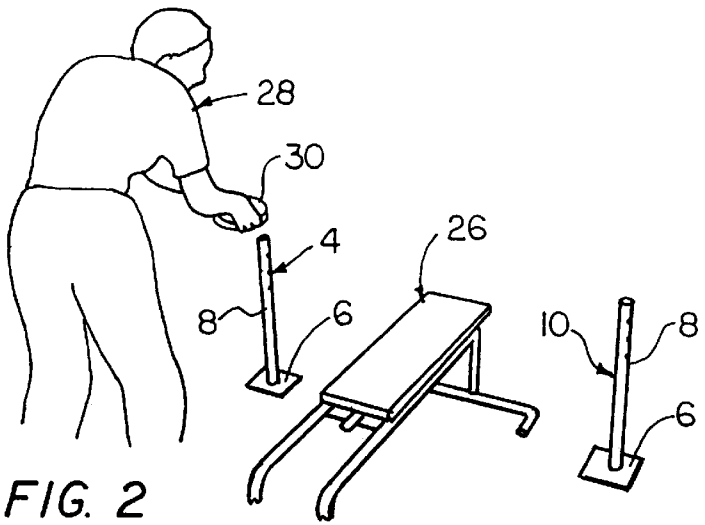

FIGS. 2–8 illustrate how the exercise apparatus 2 shown in FIG. 1 can be used without the first and the second extension members 12, 14 to perform a physical exercise known as the bench press. Thus, FIG. 2 shows how the first and the second weight-receiving means 4, 10 can be placed one on either side of a bench 26. A person 28 is shown placing a weight 30 over the upstanding member 8 of the first weight-receiving means 4. FIG. 3 shows in more detail the weight 30 being placed over the upstanding member 8.

Figure 5:
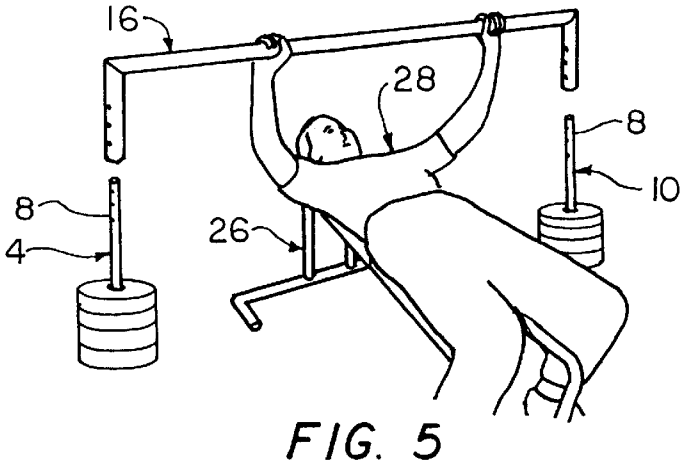
Figure 4:
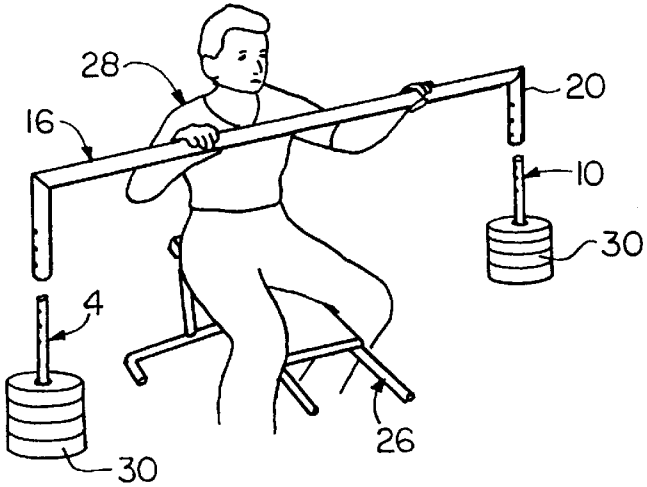

FIG. 4 shows the person 28 seated on the bench 26 and beginning to position the bar 16 ready for the releaseable connection to the first and the second weight-receiving means 4, 10. FIG. 5 shows how the person 28 has laid down on the bench 26 to give better and easier positioning of the bar 16 on the upstanding members 8 of the first and the second weight-receiving means 4, 10.

Figure 6:
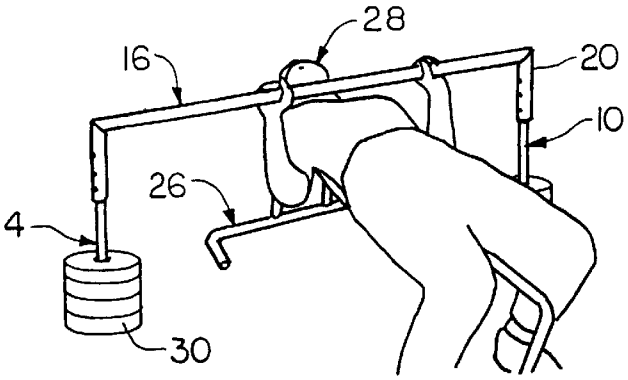

FIG. 6 shows how the first and the second right angled portions 18, 20, which are in the form of tubes, are able to slide over the upstanding members 8 ready to be connected to the upstanding members 8. The connection is only made when enough weights 30 have been positioned on the first and the second weight-receiving means 4, 10.

Figure 7:
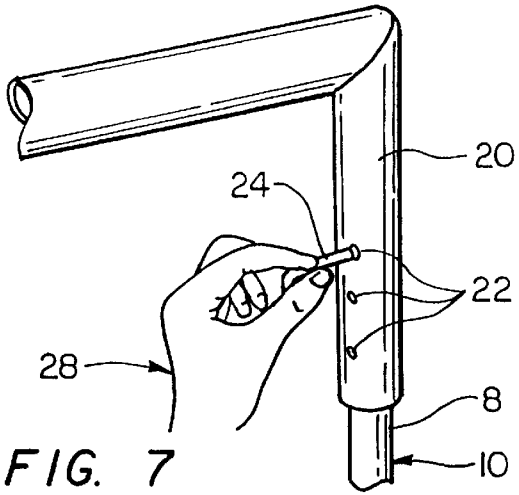

FIG. 7 illustrates how the apertures 22 in the second right angled portion 20 are brought into registry and then one of the pins 24 is used to releaseably connect the second right angled portion 20 to the upstanding member 8 of the second weight-receiving means 10.

Figure 8:
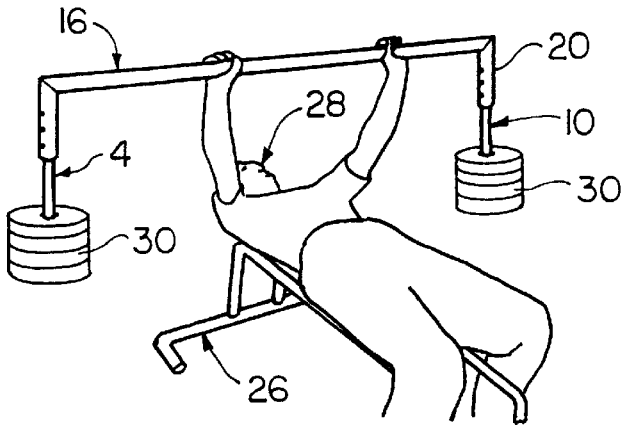

FIG. 8 shows the assembled exercise apparatus 2 being used by the person 28 for the physical exercise known as a bench press.

Figure 10:
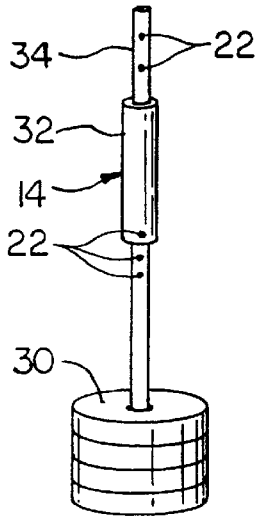
FIGS. 9–12 show how the physical exercise apparatus shown in FIGS. 2–8 can be modified by two extension members and then used to perform a physical exercise known as a squat.
Figure 9:
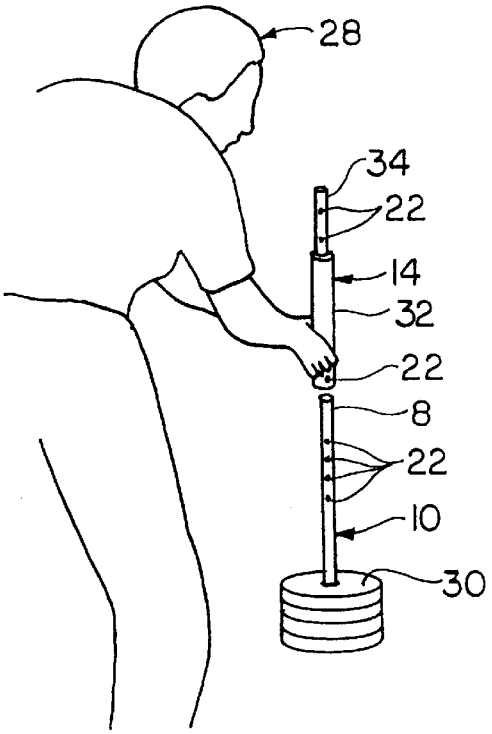
Figure 11:
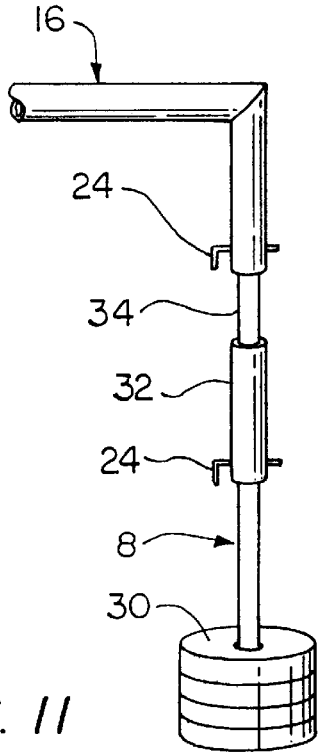

FIGS. 9, 10 and 11 show how the second extension member 14 is able to be connected to the second weight-receiving means 10. It will be seen that the second extension member 14 has a tubular portion 32 which fits over the upstanding member. The second extension member 14 also has a solid portion 34 which is provided with apertures 22 as shown and which receives one of the pins 24, see FIG. 11. Another one of the pins 24 connects apertures 22 in the tubular portion 32 to the upstanding member 8. The first extension member 12 is similarly constructed as the second extension member 14.

Figure 12:
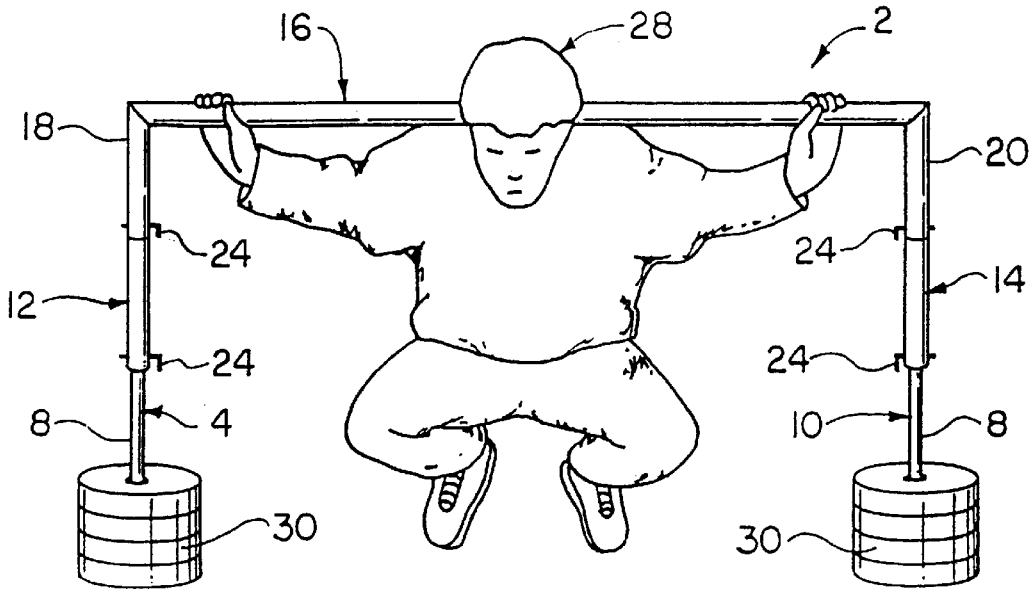

FIG. 12 shows the exercise apparatus 2 with the first and the second extension members 12, 14 in position and being used by the person 28 for a physical exercise known as a squat.

Figure 13:
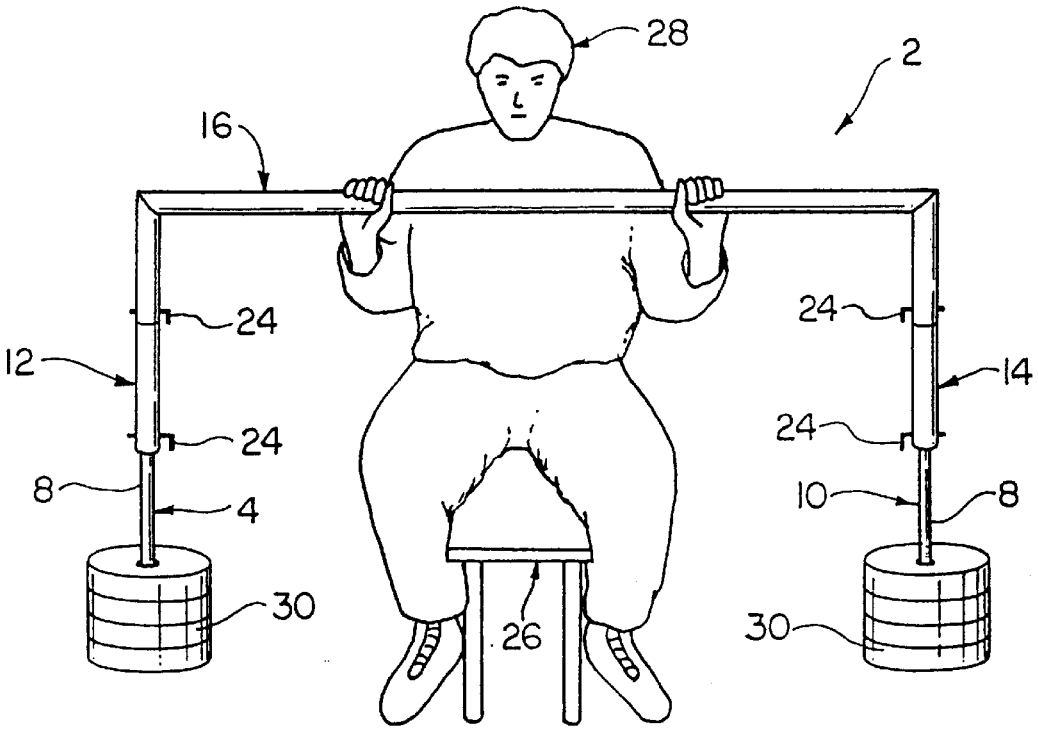
FIG. 13 shows the physical exercise apparatus of FIG. 12 being used to perform a physical exercise known as a seated shoulder press.

FIG. 13 shows the exercise apparatus 2 of FIG. 12 but being used by the person 28 for a physical exercise known as a seated shoulder press. For this exercise, the person 28 is seated as shown on the bench 26.

Figure 14:
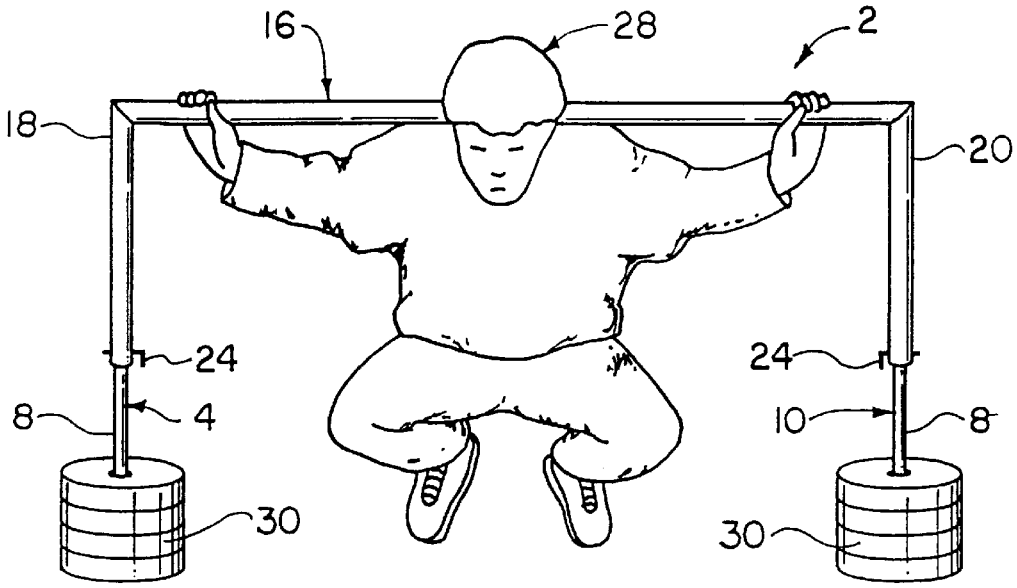
FIG. 14 shows second physical exercise apparatus of the invention which is like the physical exercise apparatus shown in FIG. 12 and which is being used to perform a squat.
Figure 15:
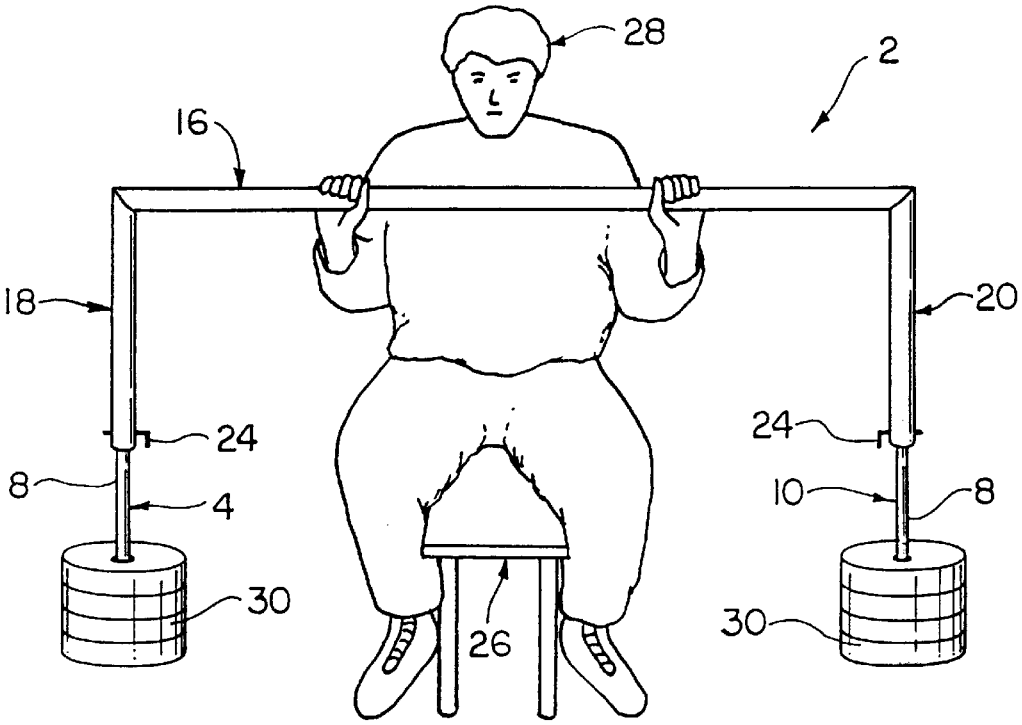
FIG. 15 shows the second physical exercise apparatus being used as in FIG. 14 to perform a seated shoulder press.

FIGS. 14 and 15 show second physical exercise apparatus being used in the same manner as in FIGS. 12 and 13 respectively. Similar parts as in FIGS. 12 and 13 have been given the same reference numerals for ease of comparison and understanding. In FIGS. 14 and 15, the first and the second end portions 18, 20 have been made longer so that they are the same length as the first and the second end portions 18, 20 in FIGS. 12 and 15 plus the first and the second extension members 12, 14. With the longer first and second end portions 18, 20, the squat and the shoulder press can be performed as shown without the need for extension members. Other suitable and appropriate physical exercises may also be performed without the extension members.

It will be appreciated from the drawings that the physical exercise 2 is free standing and stable. Thus a person can easily replace the exercise apparatus 2 on the floor at the end of an exercise. Little extra physical effort is required whilst good safety is maintained.

It is to be appreciated that the embodiments of the invention described above with reference to the accompanying drawings have been given by way of example only and that modifications may be effected. Thus, for example, the physical exercise apparatus can be used to perform other exercises including incline bench press, upright rowing, bent over rowing and shrugs. Other types of releaseable connecting means than the pin and aperture arrangements shown may be employed. The physical exercise apparatus 2 shown in FIG. 1 could be manufactured and sold without the two extension members 12, 14 if it were only desired to perform the bench press as shown in FIGS. 2–8.

I claim:

1. Exercise apparatus for use in performing a squat with weights, which exercise apparatus comprises first weight receiving means comprising a base and a first upstanding member for receiving weights, second weight receiving means comprising a base and a second upstanding member for receiving weights, and a bar which is releasably connectable by a pin and aperture arrangements to the first and second upstanding members such that the first and second upstanding members are positioned one at each end of the bar, the bar being a hollow tubular bar having an integral first right angled portion at a first end for being releasably connected to the first upstanding member such that the weights on the first upstanding member hang vertically during use, and an integral second right angled portion at a second end for being releasably connected to the second upstanding member such that the weights on the second upstanding member hang vertically in use, the first and the second right angled portions being hollow tubular portions which fit over the upstanding members of the first and second weight-receiving means, the base of each of the first and the second weight receiving means being a flat base which forms a stable platform for the first and the second weight-receiving means whereby the first and the second weight-receiving means are stable and free standing when separated from the bar and whereby the exercise apparatus is stable and free standing, and the first and the second right angled portions and the upstanding members of the first and the second weight receiving means being of such a length that when the first and the second right angled portions are connected to the first and second upstanding members the exercise apparatus is positioned for the user to perform the squat exercise with the person starting in the squat position.

2. Exercise apparatus according to claim 1 in which the pin and aperture arrangements are such that the first and the second right angled portions each have one aperture, and the upstanding members each have a plurality of apertures.

* * * * *